United States Patent [19]

Van Dort

[11] 4,453,994

[45] Jun. 12, 1984

[54] METHOD FOR INCREASING THE COVER OF TEXTILE FABRICS

[75] Inventor: Jacobus M. Van Dort, Almelo, Netherlands

[73] Assignee: Hollandse Signaalapparaten B.V., Hengelo, Netherlands

[21] Appl. No.: 227,107

[22] PCT Filed: Nov. 16, 1979

[86] PCT No.: PCT/NL79/00007

§ 371 Date: Aug. 4, 1980

§ 102(e) Date: Jul. 28, 1980

[87] PCT Pub. No.: WO80/01171

PCT Pub. Date: Jun. 12, 1980

[30] Foreign Application Priority Data

Dec. 4, 1979 [NL] Netherlands ..... 7811819

[51] Int. Cl.[3] ..... B32B 31/16

[52] U.S. Cl. ..... 156/154; 156/291; 156/305; 427/271; 427/288; 427/307; 427/336; 427/359; 427/368; 427/389.9; 427/412; 428/198; 428/261; 428/288

[58] Field of Search ..... 8/138; 57/289, 298; 156/291, 305, 308.6, 154; 428/198, 245, 261, 284, 288, 296; 427/271, 288, 307, 336, 359, 368, 389.9, 412

[56] References Cited

U.S. PATENT DOCUMENTS 3,512,232 5/1970 Bolinger ..... 57/298 X 4,159,360 6/1979 Kim ..... 428/195

*Primary Examiner*—Robert A. Dawson

*Attorney, Agent, or Firm*—Norman N. Spain

[57] ABSTRACT

In a method for increasing the cover of textile fabrics yarns are used, at least part of which exhibit potential fiber-spreading properties, which can be activated by removing from said yarns, processed into a fabric, the adhesive used for the fiber bonding in the yarn by means of a suitable solvent. The selected number of warp and weft threads per unit area is so small that on the one hand an optimal fiber spreading is obtainable, but on the other hand, after activation of the potential fiber-spreading properties, sufficient cohesion of the fibers in the fabric is retained for further processing of the fabric. After obtaining the desired fiber spreading the fiber bonding, partially lost through the activation, is at least partially restored.

3 Claims, 6 Drawing Figures

METHOD FOR INCREASING THE COVER OF TEXTILE FABRICS

The invention relates to a method for increasing the cover of textile fabrics produced from yarns, at least part of which yarns exhibiting potential fiber-spreading properties, which can be activated by removing from said yarns, processed into a fabric, the adhesive used for the fiber bonding in the yarn by means of a suitable solvent; the invention further relates to the fabric obtained by applying said method.

The U.S. Pat. No. 3,447,310 and 3,877,214 describe a method for the manufacture of twistless yarn with the possibility of removing from this yarn, processed into a fabric, the adhesive used for the fiber bonding in the twistless yarn by means of a suitable solvent. The "Lenziger Berichte", May 1977, issue 43, page 9, states that the fibers in a fabric, manufactured with twistless yarn, whereby the adhesive has been removed from the twistless yarn are of such mobility that they are able to spread in the plane of the fabric, contributing to a greater cover and a higher lustre of the fabric. For this reason, potential fiber-spreading properties are attributed to twistless yarn.

The invention has for its object to provide a new application not only to such a twistless yarn but in general to yarns with potential fiber-spreading properties, after they have at least been processed into a fabric.

According to the invention the selected number of warp and weft threads per unit area is so low that on the one hand an optimal fiber spreading is realisable but, on the other hand, after the activation of the potential fiber-spreading properties, sufficient cohesion of the fibers in the fabric remain for further processing, while after obtaining the desired fiber spreading, the fiber bonding partially lost through the activation is at any rate partially restored.

That is, through washing out the adhesive used for the fiber bonding in the yarn with the potential fiber-spreading properties, the cohesion of the fibers in the fabric is strongly reduced. The fiber bonding still remaining in the fabric is the result of the mutual fiber friction determined by the fabric structure. The remaining fiber bonding should of course be sufficient for further processing of the fabric; this bonding thus determines the minimum weave density. An optimal fiber spreading is however achieved only if the weave is sufficiently open; the requirement of a certain minimum fiber spreading determines the maximum weave density. The latter maximum limit is however such that below this limit the remaining fiber bonding will readily be so slight that the fabric is too weak for many applications. It is therefore necessary to restore the fiber bonding that was lost through the activation.

Figure 1A:
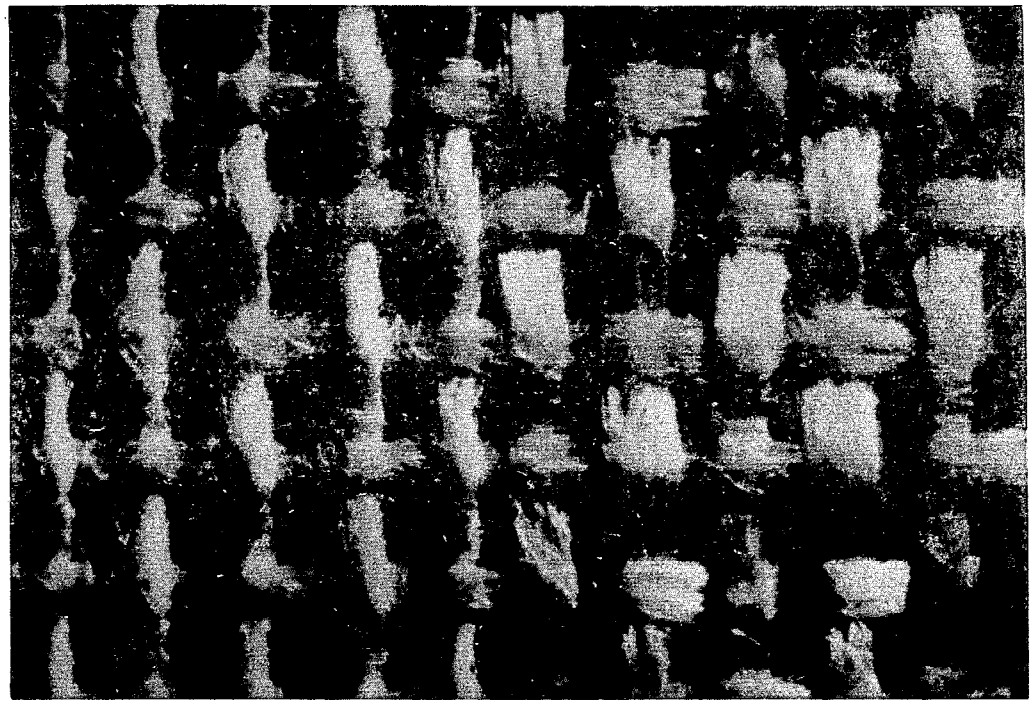
Figure 3:
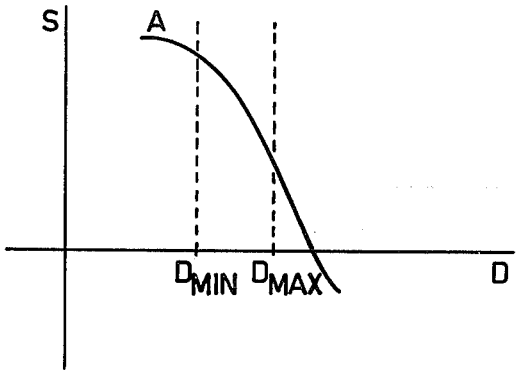
Figure 4:
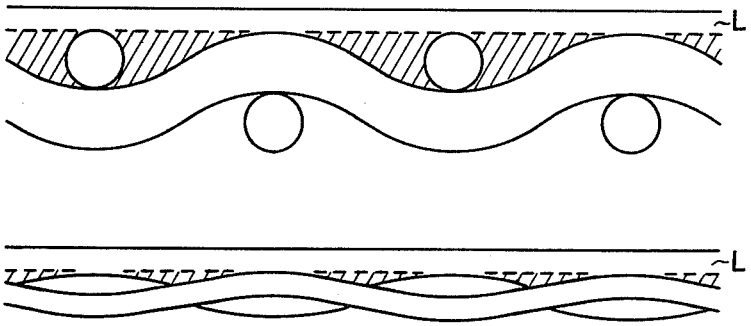

The invention and its advantages will now be described in more detail with reference to the accompanying figures, of which:

FIGS. 1A, B and 2A, B show a number of fabric fragments to illustrate the fiber spreading according to the invention; and FIGS. 3 and 4 are diagrams useful in explaining the invention and one of the advantages attached to a fabric structure according to the invention.

As already stated, potential fiber-spreading properties can be attributed to a twistless yarn. There are however other yarns exhibiting such properties. In addition to the above twistless yarn consisting of staple fibers, there is a filament yarn as such, consisting of continuous filaments which may be bonded together by an adhesive. It should be possible to remove this adhesive from the filament yarn processed into a fabric by means of a suitable solvent. The spreading of the continuous filaments incurred in the fabric with the use of the filament yarn will however be less than with twistless yarn consisting of staple fibers. The yarn as described in the Dutch patent application No. 75.07442 also exhibits potential fiber-spreading properties. This yarn consists of a filament yarn to which stable fibers are affixed with an adhesive that again, as described in the cited Dutch patent application, is removable from the yarn, processed into a fabric by means of a suitable solvent.

The Japanese patent application No. 47/112745, disclosed under No. 49/69964, describes a yarn with potential fiber-spreading properties, which yarn consists of a bundle of parallel fibers held together by a thread wrapped around the bundle. This thread consists of fibers which can be removed from the yarn processed into a fabric, as described in the cited Japanese patent application, by means of a suitable solvent. Furthermore, the U.S. Pat. No. 3,009,309 describes a "sheaved" or fascia yarn consisting of a bundle of parallel staple fibers around which staple fibers are wrapped with a certain interspacing. By substituting soluble fibers for the latter staple fibers, potential fiber-spreading properties are imparted to the sheaved or fascia yarn.

By means of the abovementioned and other yarns with potential fiber-spreading properties, a fabric may be produced in a known manner. For this purpose a yarn with potential fiber-spreading properties can be used for both the warp and the weft or for the warp or the weft only.

After obtaining a fabric, the adhesive is removed from the yarn with the potential fiber-spreading properties, as processed into the fabric. The removal of this adhesive is to be regarded as an activation of the potential fiber-spreading properties. The adhesive used for the fiber bonding in the yarn with the potential fiber-spreading properties may consist of unstabilised polyvinyl alcohol, alginate compounds, starch and starch derivatives, or cellulose di- or tri-acetates. In the first cases, the potential fiber-spreading properties are activated by washing the fabric in, if necessary heated water while in the case of the above acetate compounds the fabric is to be washed in an organic solvent, such as acetone, formic acid and acetic acid. The result is that the yarn originally exhibiting potential fiber-spreading properties is no longer present as yarn in the fabric; instead thereof a flat bundle of separate fibers and/or continuous filaments are exposed. Through the fabric structure, these separate fibers and/or continuous filaments tend to spread themselves in the plane of the fabric with the result that a better cover in the fabric is obtained.

Through washing out the adhesive the cohesion of the fibers in the fabric is strongly reduced. The strength then retained by the fabric is determined only by the mutual friction of the fibers in the fabric, which friction depends on the fiber structure. This strength should in any case be such that the fabric is suitable for further processing; this can only be achieved above a certain minimum weave density. This minimum limit is found to be at such a level that an optimal fiber spreading in the fabric is feasible. The spreading of the fibers in the fabric may be influenced by both the warp and the weft density. For example, if a ring-spun yarn is used as warp and a twistless yarn as weft, it will be clear that the weft density determines directly the fiber spreading. However, also the warp density is found to influence the fiber spreading of the weft; a high warp density increases the friction experienced by the weft fibers in the fabric in such a way that the mobility of the fibers is highly reduced. With a certain warp density the variation of the fiber-spreading S as function of the weft density D may here be represented graphically by the curve A in FIG. 3. Below the density $D_{MIN}$ the fabric does not lend itself for further processing; above the density $D_{MAX}$ the fiber-spreading is inadequate. By applying the weft of twistless yarn, being by its nature of a flat cross section, with a high density, it is possible after washing out the adhesive to force the fibers more closely together; this implies that the fiber spreading will be negative. The higher the warp density relative to the weft density, the greater the negative fiber spreading of the weft.

In the following discussion the yarn with potential fiber-spreading properties is confined to a twistless yarn. The width b of the twistless yarn is proportional to the square root of the yarn count N, expressed in tex: $b=F\sqrt{N}$ cm, where F is a proportionality factor which for example for cotton and artificial cellulose fibers is approximately $7.10^{-3}$. A twistless yarn of these fibers of about 50 tex therefore has a width of about 0.05 cm. When this yarn is processed into a fabric with a warp or weft cover of 100%, the number of threads per cm, i.e. the warp or weft density, is 20. In this case however, a fiber spreading, at any rate a positive fiber spreading cannot be obtained. In practice the yarn density should be between about 20–80% of the density as corresponds with the full cover. Below about 20% the fabric cannot be treated, while above about 80% practically no fiber spreading can be obtained. With the above yarn example, this implies that in practice the number of threads per cm lies between 4 and 16.

Reverting to the general case, in which the yarn with potential fiber-spreading properties is not confined to twistless yarn, it should be noted that the fiber spreading can be increased in so far the strength of the fabric after washing out the adhesive permits this. A roughing, brushing or scrubbing machine and/or a calendering machine may be used for this purpose.

The fiber spreading need not be distributed uniformly over the fabric. Also, according to the invention, before the removal of the adhesive used for the fiber bonding in the yarn, a permanent adhesive may be applied to the fabric in certain spots following a given pattern, which adhesive after the removal of the former adhesive ensures that the fiber spreading occurs only at the places not provided with the permanent adhesive.

In this way it is achieved that fabrics may be provided with various patterns which manifest themselves as complementing fragments with or without a certain fiber spreading.

Patterns may also be provided in the fabric by subjecting the fabric, after activation of the potential fiber-spreading properties, to a treatment in which the fiber spreading is reinforced only in certain spots by mechanical means; reference should be had to "Textile Month", Nov. 1978, page 94.

After spreading of the fibers in the fabric the fiber bonding, lost through the adhesive being washed out, should be restored; the fiber is to be reinforced in such a way that it as final product again exhibits usable properties. The fiber bonding may be restored in various ways, viz. by a permanent adhesive, by applying a substrate to the fabric by means of a permanent adhesive, and by special coatings.

Restoration of the fiber bonding by a permanent adhesive may for example be effected by adding a fusable fiber to the basic material in the manufacture of the yarn with potential fiber-spreading properties. After obtaining a fabric by means of the yarn so obtained and after desizing this fabric and so having effected the fiber spreading, the fusable fiber in the fabric can be activated by subsequent calendering. Suitable fusable fibers are copolymers of vinyl chloride and vinyl acetate with a melting point of 80°–140° C., copolyamides with a melting point of 110°–150° C., and bicomponent fibers, such as polypropylene with a polyethylene coating of which the melting point is ~130° C., or polyamide 6.6 with a coating of polyamide 6.

Also the application of special coatings gives great advantages. FIG. 4 shows a diagram of a fabric with a ring-spun warp and weft and a fabric with a warp and weft of twistless yarn, from which the adhesive has been removed. The two fabrics are provided with a coating L, while in the two fabrics the additionally required coating substance used for the fabric filling is shown by the hatched part. By producing the fabric from a twistless yarn and subsequently washing out the adhesive, a considerable saving in the amount of coating substance used can be achieved, as seen from the bottom diagram of FIG. 4. Moreover, the amount of coating substance penetrating through the fabric is reduced, just because of the much better cover. A further advantage in the application of coatings to a fabric of twistless yarn, from which the adhesive is removed, is the substantially better adhesive power between fabric and coating. In the publication "Confectie", Vol. 25(1977), No. 11 (Nov.), page 41, this adhesive power is described to increase as the warp or weft yarns are spun with less twist. With the use of twistless yarns the adhesive power will therefore be optimal. Finally it should be noted that, because the here described fabrics can be produced on the one hand with a lower density and on the other hand still have a greater cover, these fabrics, provided with local adhesive coatings, lend themselves particularly well for fusible interlinings on other fabrics.

EXAMPLE 1

Figure 1B:
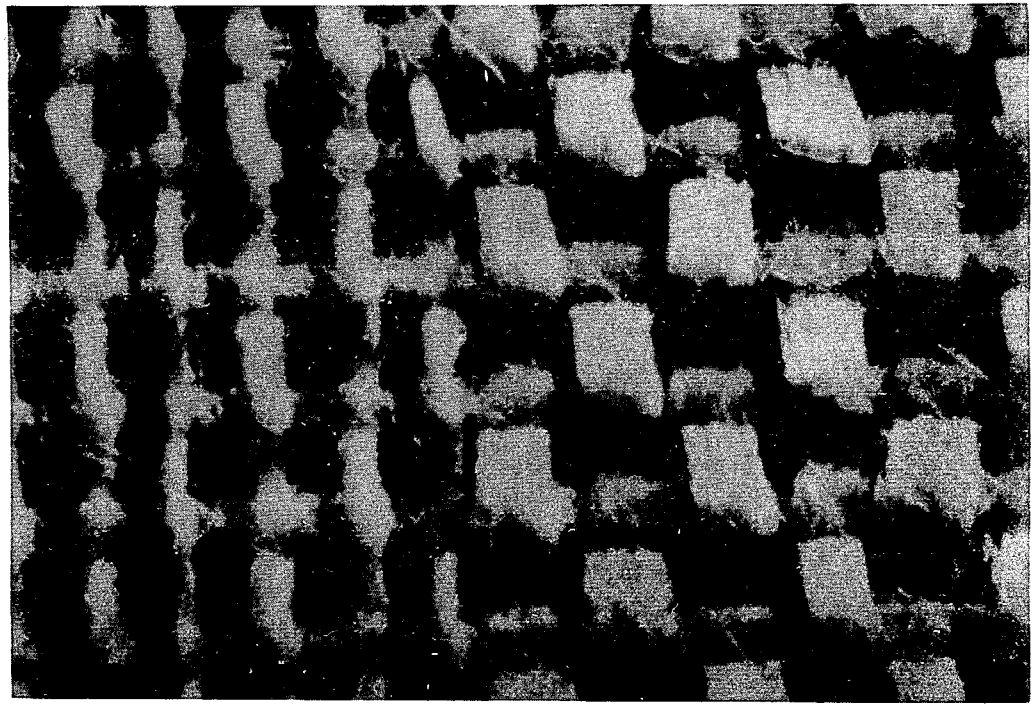

FIG. 1A is a fragment of a cloth from the loom, where the warp consists of a 49-tex twistless yarn comprising 90% viscose rayon fibers and 10% unstabilised polyvinyl alcohol. The yarn width of the warp was 0.0577 cm, the number of threads per cm 7.7, and hence the cover 44.4%. In the upper part of the figure a weft of twistless yarn can be seen; this yarn consisting of 94.5% viscose rayon fibers and 5.5% unstabilised polyvinyl alcohol, had a yarn count of 49 tex. The yarn width of this weft was 0.0615 cm, the number of threads per cm 10.0, and hence the cover 61.5%. The bottom part of the figure shows a weft of ring-spun yarn; this yarn, consisting of viscose rayon, also had a yarn count of 49 tex. The yarn width of this weft was however 0.0359 cm, the number of threads per cm again 10.0, and hence the cover 35.9%. The clear difference in cover is attributable to the inherent flat cross section of the twistless yarn. The fiber-spreading properties of the twistless yarn are however seen from FIG. 1B; this figure shows a fragment of the same cloth as illustrated in FIG. 1A, but after desizing of this cloth, i.e. after removal of the polyvinyl alcohol from the twistless yarn. After washing out the polyvinyl alcohol the twistless weft had a yarn count of only 46 tex, a yarn width of 0.0792, while the number of threads per cm. was 10.6. Hence, the cover of this weft was 84.0%. The ring-spun weft of 49 tex then had a yarn width of 0.0397 cm, while the number of threads per cm was 10.6. The cover of the ring-spun weft was therefore 42.1%. Through the desizing of the cloth from the loom the cover of the twistless weft was raised from 61.5% to 84.0%, and that of the ring-spun weft from 35.9% to 42.1%. The strong increase in the cover of the twistless weft is due to the fiber spreading incurred.

EXAMPLE 2

Figure 2A:
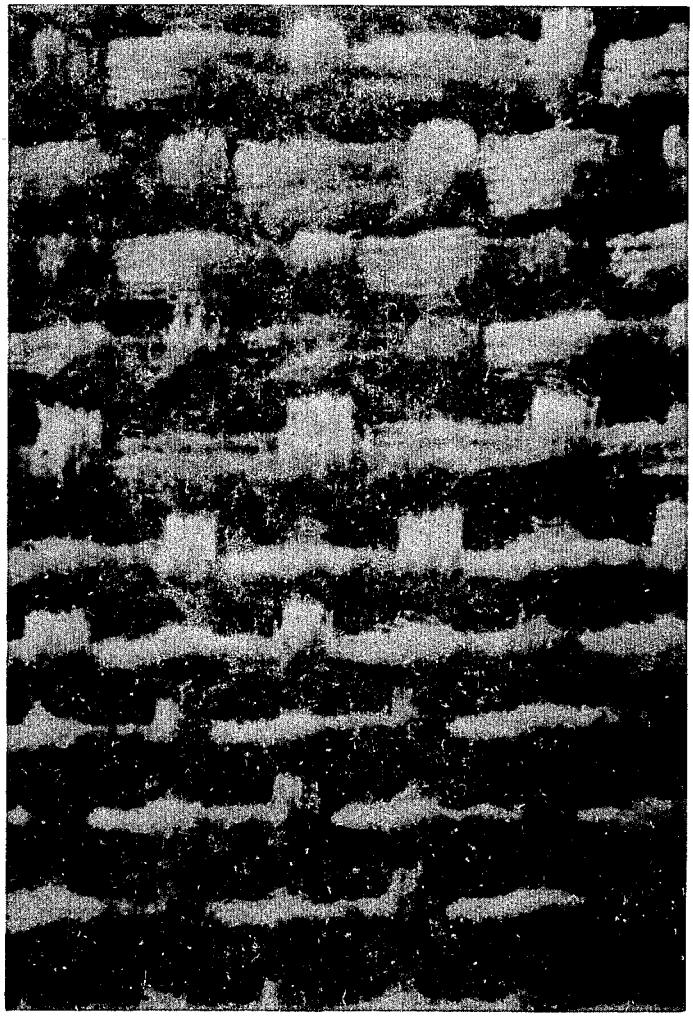
Figure 2B:
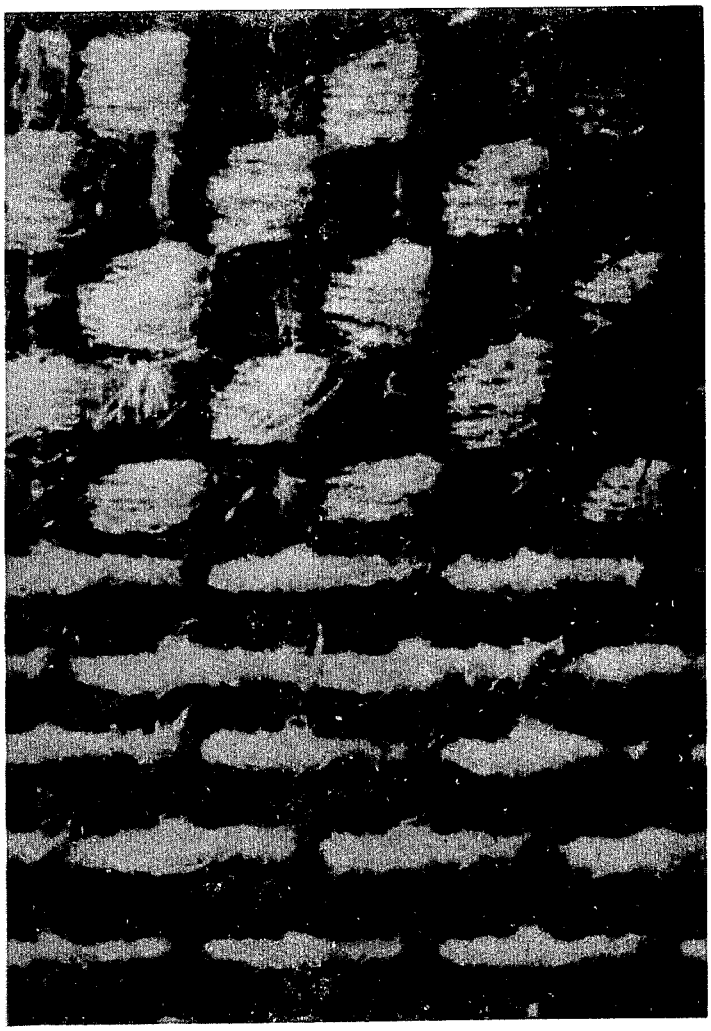

FIG. 2A shows a fragment of a cloth from the loom, where the warp consists of a 49-tex twistless yarn comprising 90% viscose rayon fibers and 10% unstabilised polyvinyl alcohol. The yarn width of the warp was 0.0692, the number of threads per cm 7.7 and hence the cover 53.3%. In the upper part of the figure a weft of twistless yarn can be seen; this yarn, consisting of 90% cotton fibers and 10% unstabilised polyvinyl alcohol, had a yarn count of 59 tex. The yarn width of this weft was 0.0718 cm, the number of threads per cm 10.0, and hence the cover 71.8%. The lower part of the figure shows a weft of an open-end spun yarn; this yarn, consisting of cotton, also had a yarn count of 59 tex. The yarn width of this weft was however 0.0378 cm, the number of threads per cm again 10.0, and hence the cover 37.8%. Also in this case the clear difference in cover is attributable to the inherent flat cross section of the twistless yarn. FIG. 2B illustrates again a fragment of the same cloth as illustrated in FIG. 2A, but after desizing of this cloth. After washing out the polyvinyl alcohol the twistless weft had a yarn count of only 53 tex, a yarn width of 0.0949 cm, while the number of threads per cm was 10.4. Hence, the cover of this weft was 98.7%. The 59-tex weft of open-end spun yarn had then a yarn width of 0.0423 cm, while the number of threads per cm was 10.4. Hence, the cover of this open-end spun weft was 44.0%. Through the desizing of the cloth, the cover of the twistless yarn was raised from 71.8% to 98.7%, and that of the open-end spun weft from 37.8% to 44.0%. Again in this case the strong increase of the cover of the twistless weft is due to the fiber spreading incurred.

What we claim is:

1. A method for increasing the cover of a woven textile fabric produced from yarns, at least part of which yarns exhibit potential fiber-spreading properties, containing a fiber-bonding adhesive, which fiber-spreading properties are activatable by removing from said yarns, processed into said fabric, said fiber-bonding adhesive by means of a suitable solvent, characterized in that the number of warp and weft threads per unit of length lies between 20 and 80% of the number of warp and weft threads that provide a 100% cover of said fabric after removal of said fiber-bonding adhesive, said fiber-bonding adhesive is removed from said fabric to activate said fiber-spreading properties, said fibers are mechanically spread and, after said spreading of said fibers, the strength of said fabric which has been partially lost through said activation is at least partially restored by the application of a permanent adhesive to said fabric.

2. The method of claim 1 characterized in that before removal of the adhesive employed for the fiber-bonding in the yarns a permanent adhesive is applied to said fabric in spots according to a given pattern, the presence of which permanent adhesive ensures, after removal of said fiber-bonding adhesive, that the fiber spreading occurs only at those places in said fabric not provided with said permanent adhesive.

3. The method of increasing the cover of a woven textile fabric as claimed in claim 1 or 2 characterized in that said fiber-spreading is accomplished by subjecting said fabric to the action of a roughing, brushing, scrubbing and/or calendering machine.

* * * * *